US007003249B2

(12) United States Patent
Hasegawa et al.

(10) Patent No.: US 7,003,249 B2
(45) Date of Patent: Feb. 21, 2006

(54) DEVELOPING APPARATUS INCLUDING AGITATING MEMBER

(75) Inventors: Hideaki Hasegawa, Shizuoka (JP); Kazumi Yamauchi, Shizuoka (JP); Yoshihiro Ogawa, Shizuoka (JP); Norihito Naito, Shizuoka (JP); Yasunao Otomo, Shizuoka (JP); Nobuo Oshima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 187 days.

(21) Appl. No.: 10/701,417

(22) Filed: Nov. 6, 2003

(65) Prior Publication Data

US 2004/0096241 A1 May 20, 2004

(30) Foreign Application Priority Data

Nov. 8, 2002 (JP) ..... 2002-326168

(51) Int. Cl.
*G03G 15/08* (2006.01)

(52) U.S. Cl. ..... 399/254; 399/256; 399/265; 399/279

(58) Field of Classification Search ..... 399/256, 399/265, 279, 254
See application file for complete search history.

(56) References Cited

U.S. PATENT DOCUMENTS

| | | | | |
|---|---|---|---|---|
| 5,466,555 | A | 11/1995 | Taguchi et al. | 430/110 |
| 6,197,470 | B1 | 3/2001 | Tamura | 430/110 |
| 2001/0009624 | A1 | 7/2001 | Abe et al. | 399/252 |

FOREIGN PATENT DOCUMENTS

| | | | |
|---|---|---|---|
| JP | 6-230604 | | 8/1994 |
| JP | 6-242630 | | 9/1994 |
| JP | 7-281478 | | 10/1995 |
| JP | 2000-147832 | | 5/2000 |
| JP | 2000-284522 | | 10/2000 |
| JP | 2000-310884 | | 11/2000 |
| JP | 2001-201931 | | 7/2001 |
| JP | 2002-278147 A | * | 9/2002 |

* cited by examiner

*Primary Examiner*—Susan Lee
(74) *Attorney, Agent, or Firm*—Fitzpatrick, Cella, Harper & Scinto

(57) ABSTRACT

A developing apparatus includes a rotatable, developer carrying body for carrying a one-component developer and a rotatable, agitating member for agitating the one-component developer. The one-component developer is magnetic toner at least containing a bonding resin and magnetic iron oxide. When wettability of the magnetic toner relative to a mixture solution of methanol and water is measured at the transmittance of light having a wavelength of 780 nm, a methanol concentration at the transmittance of 80% is within the range of 45 to 65 volume %, and wherein $0.1 \leqq b/a \leqq 0.2$ is established where a (rps) denotes the rotation speed of the developer carrying body, and b (rps) denotes the rotation speed of the agitating member.

12 Claims, 6 Drawing Sheets

DEVELOPING APPARATUS INCLUDING AGITATING MEMBER

BACKGROUND OF THE INVENTION

1. Field of the Invention

The present invention relates to a developing apparatus, preferably employed for an image processing apparatus that uses an electrophotographic system, and to a detachable processing cartridge, which is also employed for the image processing apparatus.

This image processing apparatus in question can be, for example, an electrophotographic printer that uses an electrophotographic system, such as an electrophotographic copier, an LED printer or a laser beam printer, or an image processing apparatus that uses an electrostatic recording system, such as an electrophotographic facsimile machine. The processing cartridge is provided by integrally constituting an image bearing member, such as an electrophotographic photosensitive member, and, at the least, one either of electrifying means, developing means or cleaning means and an image bearing member, and is detachable from the main body of the image processing apparatus.

2. Related Background Art

In an electrophotographic image processing apparatus, such as a copier or a laser beam printer, light is emitted by exposure means in accordance with image data to an electrophotographic photosensitive member (hereinafter referred to simply as a photosensitive member), which is an image bearing member charged by electrifying means, and a latent image is formed thereon. A developing apparatus supplies to the latent image a developer (toner), which is a recording material, and visualizes the latent image to obtain a developed image (toner image). Then, the toner image is transferred from the photosensitive member to a recording sheet, a recording medium, so as to record the image thereon.

A developer container (a toner container), which is a toner storage unit, is connected to the developing portion of the developing apparatus, and toner is consumed as images are formed. For many image processing apparatuses, the developing apparatus, which includes the toner container as the developing means, the photosensitive member, which serves as the image bearing body, and the electrifying means, which electrifies the surface of the photosensitive member so that a latent image can be formed thereon, are integrally formed and function as a processing cartridge. When the supply of toner is exhausted in a processing cartridge, a user need only exchange the processing cartridge to again perform the image forming processing.

Practical use has been made of various electrophotographic developing methods. And since a developing apparatus having the simplest structure has the fewest troubles and the longest service life and is the most easily maintained, a one-component developing method using a magnetic toner has been widely employed.

Recently, since higher speed and longer service life are capabilities requested for a processing cartridge because the speed of a laser beam printer is thereby increased, an increase in the amount of toner loaded in a processing cartridge is sought, and thus, the capacity of a toner container must also be increased.

To increase the speed and the capacity of a processing cartridge, a higher processing property is requested for toner, and since the following (A) low-temperature fixing properties and (B) electrification stability properties are especially important, various proposals have been made.

An explanation will now be given for (A) a low-temperature fixing property.

For a fast developing system, toner for which polyester is the main component of a bonding resin is generally employed in order to prevent a fixing failure during the fixing processing performed to fix toner to a recording medium using heat and pressure.

Compared with the styrene-acrylic toner that has been widely employed, polyester toner has a lower glass transfer temperature (Tg) and a superior low-temperature fixing property, and is appropriate for a fast fixing system.

However, since polyester is highly hygroscopic and hydrophilic, in an environment at a high temperature and a high humidity, the flowability of the toner is deteriorated due to the hygroscopicity of the polyester resin, and various problems occur.

As for polyester toner, a technique is disclosed in Japanese Patent Application Laid-Open No. 2000-147832, according to which the ratio of the content of a specific molecular component of the polyester resin is changed in order to improve the low-temperature fixing property and a high-temperature resistance offset property. Further, another technique is disclosed in Japanese Patent Application Laid-Open No. 6-242630, according to which the surface property and the flowability of toner are improved by using hydrophobic silica as an outward additive.

However, these two proposals are not related to the techniques employed for improving the hydrophobic property of polyester toner, and still more improvement is required for the flowability of toner in a high temperature and high humidity environment.

An explanation will now be given for (B) electrification stability.

Electrification stability is important for a developing system in which a large amount of toner is stored, i.e., the toner electrification amount must be quickly increased, the environment stability must be superior, and stable electrification of the toner must be performed for an extended period of time.

Magnetic iron oxide is contained in toner to provide magnetism for the toner, and a state wherein magnetic iron oxide is dispersed across the surface of the toner particles greatly influences the electrification property of the toner.

As less magnetic iron oxide is exposed at the surface of the toner particles, i.e., as more of the surface of the toner particles is covered with the bonding resin component, the electrification property of the toner is improved, and a superior development function is obtained. On the other hand, this may cause over-electrification in a low temperature and low humidity environment.

On the other hand, as more magnetic iron oxide is exposed on the surface of the toner particle, i.e, as less of the surface of the toner particle is covered with the bonding resin component, the magnetic iron oxide on the surface of the toner particle serves as an electrification leakage site. Therefore, especially in a high temperature and high humidity environment, the toner is not satisfactorily electrified and deterioration of the developing function occurs, which causes an image failure.

More natural is for the electrification property of the toner to be improved by using an outward additive, such as inorganic particles or a metal oxide material. However, for a developing system for which a long service life is desired, a change in the electrification property, which occurs due to a separation or a parting of the outward additive after it has been in use for a long time, must be avoided. Therefore, it is important that the toner electrification amount be controlled by using a so-called toner parent body, such as a bonding resin or magnetic iron oxide, rather than by using an outward additive. That is, it is important that an appropriate amount of the magnetic iron oxide exposed on the surface of the toner particle be maintained.

To obtain the amount of magnetic iron oxide present on the surface of the one-component magnetic toner particles, a method is available for evaluating the hydrophobicity of a specific toner solvent, i.e., for evaluating the wettability of a specific organic solvent.

In the wettability evaluation, the wetting (sedimentation) of toner for a specific organic solvent is measured by permeability, and the wettability (the hydrophobicity relative to water) of the specific organic solvent is obtained. That is, when wetting of a toner tends to occur at a low density, it means that its hygroscopic property is high. Generally, a solvent mixture consisting of methanol and water is employed as a specific organic solvent.

The wettability of magnetic toner relative to a methanol-water mixture solvent is greatly influenced by the composition of the surface material of the one-component magnetic toner particles and the existing material state. As less magnetic iron oxide is exposed on the surface of the toner particles, i.e., when more of the surface of the toner particle is covered with the bonding resin component, the wetting of the magnetic toner occurs at a high methanol concentration, i.e., wetting of the toner is not easy. On the other hand, as more magnetic iron oxide is exposed on the surface of the toner particle, i.e, when less of the surface of the toner particle is covered with the bonding resin component, the wetting of magnetic toner occurs at a low methanol concentration, i.e., the wetting of the magnetic toner is easy.

When more magnetic iron oxide is exposed on the surface of the toner particles, the electrification capability is reduced and the wettability is deteriorated, so that in a high temperature and high humidity environment, the flowability of the toner tends to be deteriorated. In other words, in order to prevent the magnetic toner from being over-charged in a low temperature and low humidity environment, and to stabilize the long term electrification of the toner, the magnetic iron oxide on the surface of the toner particles must be exposed and dispersed, to a degree; however, the magnetic iron oxide exposed on the surface of the toner particles deteriorates both the wettability of the toner and the flowability of the toner in a high temperature and high humidity environment.

Especially for a fast developing system that stores a large amount of toner, since from the viewpoint of image fixing at a low temperature, polyester toner must be employed, the flowability of toner in a high temperature and high humidity environment is more remarkably deteriorated due to hygroscopicity (hydrophile), and the following problems occur.

As a first problem, since toner is not uniformly supplied to a developing roller that is a developer carrying member for carrying toner from a toner container to a photosensitive member, an image failure, such as fading, occurs.

As a second problem, since toner that is scraped from the developing roller by a regulating member remains on the reverse side of the developing roller, and since over-charging occurs because of the continuous fiction of the toner against the developing roller, a reduction in image density and an image failure such as fogging occur.

As a third problem, since a toner that cannot be circulated due to poor flowability is maintained on the reverse side of the developing roller, and since the toner is subjected to friction heat generated near the developing roller, the toner is thermally damaged (toner deterioration) and an image failure occurs.

As a fourth problem, since packing for toner having poor flowability tends to occur due to the weight of the toner in a large toner container, and when toner in this state is retained in an environment at a high temperature and a high humidity, blocking in the toner container will occur.

To resolve the first to fourth problems, an improvement in the flowability of toner is proposed that uses a technique disclosed in Japanese Patent Application Laid-Open No. 7-281478 for changing the property of a resin, a technique disclosed in Japanese Patent Application Laid-Open No. 2000-284522 for changing the flowability using wax contained in the toner particles, or a technique disclosed in Japanese Patent Application Laid-Open No. 6-230604 for changing the flowability index of a magnetic member.

Further, while taking the hydrophobicity of toner into account, toner containing high hydrophobic silica as an outward additive is disclosed in Japanese Patent Application Laid-Open No. 2000-310884.

Furthermore, for the structure of a developing apparatus that stores a large amount of toner, a technique is disclosed in Japanese Patent Application Laid-Open No. 2001-201931 according to which a toner container in which toner is stored is defined to provide a plurality of chambers, and the toner is agitated and carried by agitating members provided in the individual chambers.

According to this technique, since the toner weight can be dispersed and the circulation of toner in the toner container is greatly enhanced, toner deterioration due to poor toner circulation does not occur, even when a large amount of toner is stored in a toner container, and preferable images can be obtained when the toner is used for an extended period of time.

However, since the flowability improvement techniques disclosed in Japanese Patent Application Laid-Open Nos. 7-281478, 2000-284522 and 6-230604 respectively provide for the changing of the property of the resin, by changing the flowability of the wax contained in the toner particles, and by changing the flowability index of the magnetic member, the properties of various toner materials can be changed to obtain a desired toner index flowability, while the costs will be increased and a preferable development characteristic may not be obtained.

In addition, according to the method disclosed in Japanese Patent Application No. 2000-310884 for using an outward additive, while the outward additive is highly hydrophobic, it is difficult to say that the original hydrophobicity of the toner will be achieved because the state wherein the outward additive is dispersed across the surface of the toner particles will differ, depending on an outward additive type. Especially for a fast developing system for which a large amount of toner is used, it is important that, when the toner usage term is long, a stable toner electrification amount be maintained without the toner characteristic being changed, and an improvement in the toner characteristic (hydrophobicity), using only the outward additive, will not be satisfactory.

Further, for a fast developing system requested for long-term use, it is not sufficient for a highly hydrophobic toner to be employed, and it goes without saying that optimization of the structure of the developing apparatus must be a requisite.

Furthermore, for the technique disclosed in Japanese Patent Application Laid-Open No. 2001-201931, wherein the toner container for the developing apparatus, in which a large amount of toner can be stored, is defined as including a plurality of chambers, and the toner is agitated and carried by agitating members, provided in the individual chambers, and an increase in the size of the toner container can not be avoided, and since multiple agitating members are required, the size and the costs will also be increased.

There is another method proposed, whereby control means, for controlling the rotational speed of an agitating member, and agitating member driving means are provided, and the rotational speed of the agitating member is changed in accordance with the environment and state of the usage, so that the toner electrification amount is stabilized and circulation of the toner is controlled. According to this method, however, since both the driving means and the control means are required, the size and the cost of the developing apparatus are also increased.

SUMMARY OF THE INVENTION

It is one objective of the present invention to provide a developing apparatus for performing developing using magnetic toner having a superior low-temperature fixing property.

It is another objective of the present invention to provide a developing apparatus that can prevent the deterioration of the flowability of toner.

It is an additional objective of the present invention to provide a developing apparatus having superior environmental stability.

It is a further objective of the present invention to provide a developing apparatus that can form a satisfactory image without having to generate an image failure during the long term usage.

It is a still further objective of the present invention to provide a developing apparatus that can appropriately circulate toner.

It is one more objective of the present invention to provide a developing apparatus that can store a large amount of toner and that is appropriate for a fast developing system.

Other objectives and features of the present invention will become apparent in due course during the following detailed description given while referring to the accompanying drawings.

DETAILED DESCRIPTION OF THE PREFERRED EMBODIMENTS

A developing apparatus according to the present invention will now be described in detail while referring to the accompanying drawings.

First Embodiment

Figure 2:
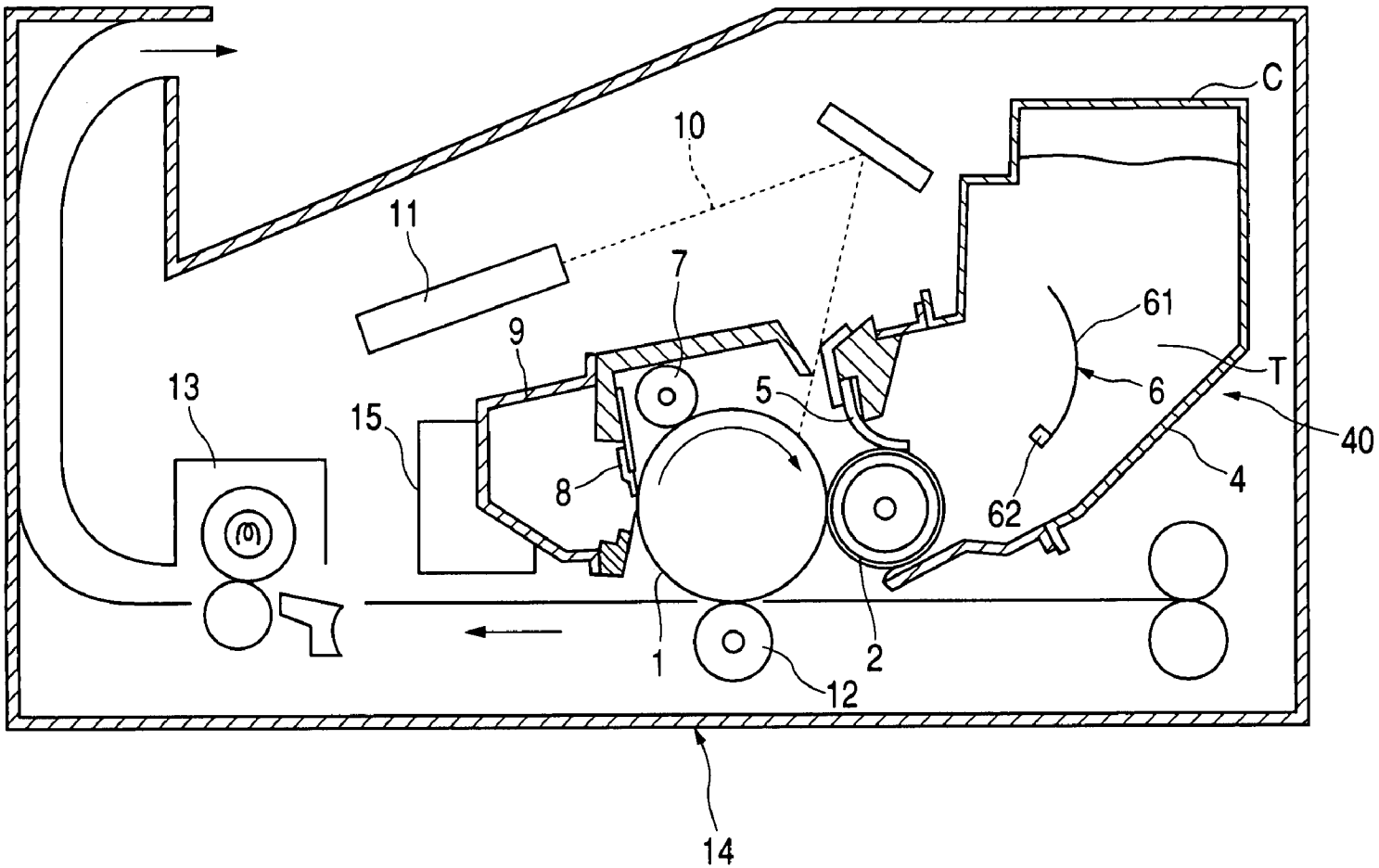
FIG. 2 is a schematic diagram showing an example configuration for an image forming apparatus according to the present invention.

An image forming apparatus using a developing apparatus can be applied for an electrostatic recording system, and more especially for an electrophotographic system. As is shown in FIG. 2, an image forming apparatus 14 for a first embodiment is a laser beam printer that receives image data from a host computer or over a network, and that outputs a corresponding image to a recording sheet. Through prescribed procedures, a processing cartridge C can be inserted into or removed from a predetermined section (loading means 15) of the main body of the image forming apparatus 14.

Figure 1:
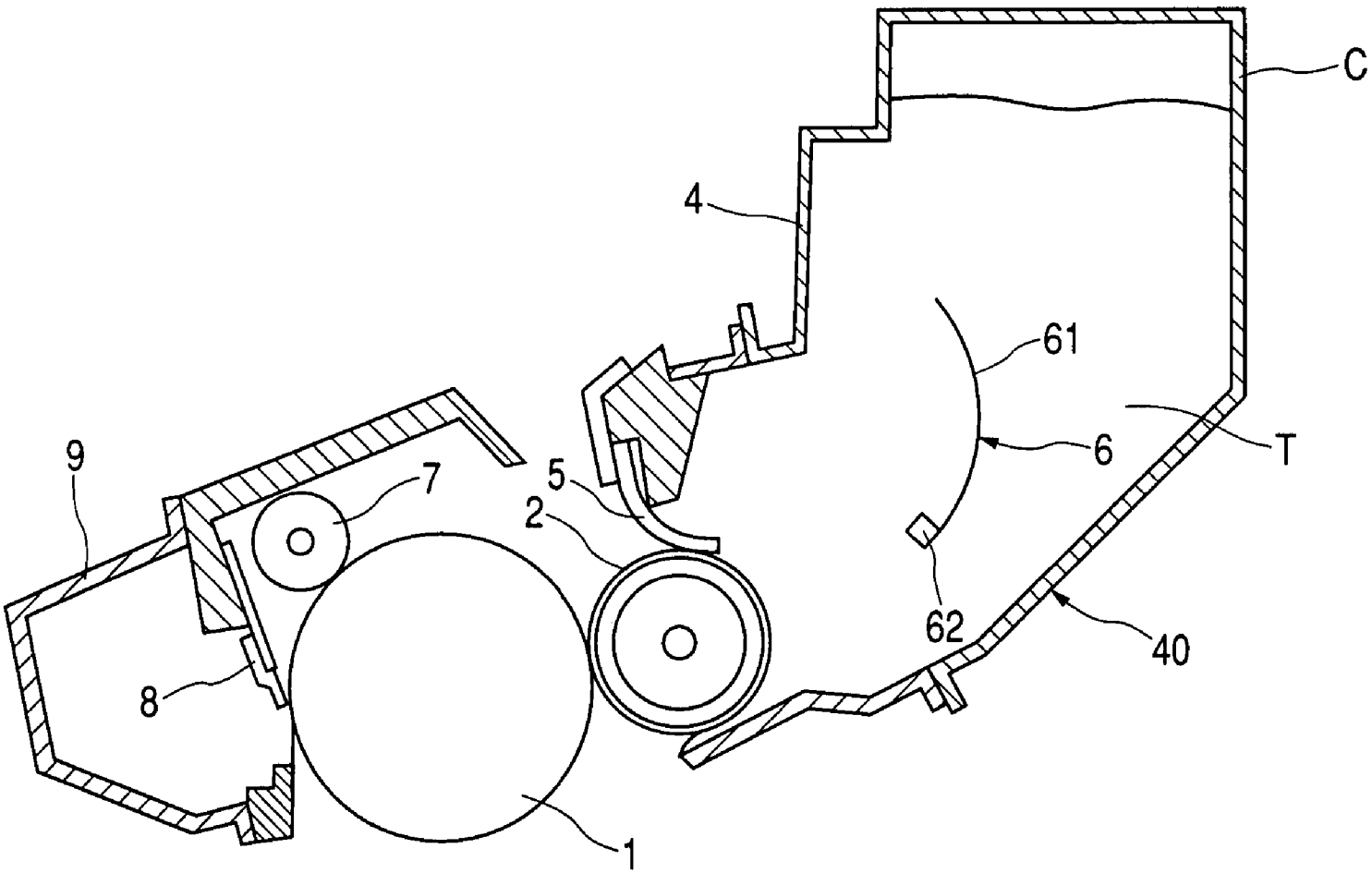
FIG. 1 is a cross-sectional view of an example processing cartridge according to the present invention.

The processing cartridge C loaded into the image forming apparatus 14 is shown in FIG. 1. As is shown in FIG. 1, the processing cartridge C includes: an electrophotographic photosensitive member (hereinafter referred to simply as a photosensitive member) 1 that is an image bearing member; electrifying means 7, for uniformly charging the photosensitive member 1; a developing roller 2, which is a developer carrying member; a toner regulating member 5; a developer container (toner container) 4, which is a storage unit for a developer (toner) T connected to the developing roller 2 and the toner regulating member 5; an agitating member 6, which is located inside the toner container 4 and which agitates the toner in the toner container 4; cleaning means 8; and a waste toner container 9, by which waste toner, removed from the photosensitive member 1 by the cleaning means 8, is collected, all portions of which are integrally formed. The developing roller 2, the toner container 4, the toner regulating member 5 and the agitating member 6 constitute a developing apparatus 40, which serves as developing means located opposite to but not in contact with the photosensitive member 1.

In the laser printer, which is the image forming apparatus 14, to which the process cartridge C is detachably attached, as is shown in FIG. 2, a laser scanner 11, which is exposure means for emitting a laser beam 10 in consonance with image data, is located above the process cartridge C, while transfer means 12 is located opposite the photosensitive member 1 and under the process cartridge C.

With this arrangement, the photosensitive member 1 is uniformly charged by electrifying means 7, and the surface of the photosensitive member 1 is scanned by the laser beam 10 emitted by the laser scanner 11, so that an electrostatic latent image for desired image data is formed. By the action of a developing bias applied to the developing roller 2 of the developing apparatus 40, the toner T in the toner container 4 is attached to the electrostatic latent image thus formed on the surface of the photosensitive member 1, and a visual developed image (toner image) is obtained. It should be noted that the developing bias is a direct-current and alternating-current superposed voltage. The toner image on the photosensitive member 1 is transferred by the transfer means 12 to a recording sheet that is a recording medium. As the recording sheet is passed through the fixing means 13, the toner image is fixed as a final image, and the recording sheet is discharged outside the main body.

The one-component magnetic toner T that is a developer sued for this invention will now be described in detail.

The magnetic toner T contains a bonding resin whose main component is a polyester resin, and also contains magnetic iron oxide. To optimize the exposing of magnetic iron oxide on the surface of the toner particle, it is preferable that the magnetic iron oxide contain 0.1 to 2.0 mass % of the Si element of the total of the magnetic iron oxide, and 0.12 to 4.0 mass % of at least one of elements Mg, Cu, Zn, Ti and Al. Si in the magnetic iron oxide is effective to rise the electrification of toner, and Zn is superior to obtain a balance in the exposure of the magnetic iron oxide on the surface of the toner, and is effective to provide the environmental stability for the toner electrification amount.

A method for preparing magnetic iron oxide particles will be briefly explained.

(S1) After sodium silicate is added to a iron sulfate solution so that the content of the silicon element is 0.48% relative to the iron element, this solution is mixed with a caustic soda solution to prepare a solution containing iron hydroxide. (S2) While the pH of the solution is adjusted to 10, air is blown into the solution to cause an oxidization reaction at 80 to 90° C., and a slurry solution is prepared to generate a seed crystal. (S3) When it is confirmed that the seed crystal has been generated, an iron sulfate solution is further added to the slurry solution as needed, and while the pH of the slurry solution is adjusted to 10, air is blown into the solution to continue an oxidization reaction. During this period, the progress rate of the reaction is examined while monitoring the concentration of non-reacted iron hydroxide, and zinc sulfate is added, as needed. Further, the pH of the solution is controlled step by step, e.g., pH is 9 at the initial stage of the oxidization reaction, 8 at the intermediate stage, and 6 at the final stage, so that the distribution of the metal element in the magnetic iron oxide is controlled. Thereafter, the oxidization reaction is terminated. (S4) The prepared magnetic iron oxide particles are washed, filtrated and dried by the normal method. (S5) Since the primary particles of the thus obtained magnetic iron oxide particles are cohered to form an aggregate, a compression force or a shearing force is exerted by a mix muller to the aggregate of the magnetic oxide iron particles, and the aggregate is shattered to obtain the magnetic iron oxide particles as the primary particles. In addition, the surfaces of the magnetic iron oxide particles are smoothed to obtain the desired magnetic iron oxide particles.

The toner manufacturing method will now be briefly explained.

(S1) A mixture described below is fused and mulled by a biaxial extruder heated at 140° C., and the cooled mulled material is roughly crushed by a hammer mill. The obtained rough material is mechanically pulverized by using a turbo mill (by TURBO KOGYO Co., Ltd.), and the obtained ground powder is classified by a fixed-wall wind classifier to generate classified powder. (S2) Further, too fine particles and coarse particles are strictly and simultaneously removed from the obtained classified powder by a multi-classifier (elbow jet classifier by Nittetsu Mining Co., Ltd.) employing the Coanda effect. As a result, negative electrified magnetic toner particles having the weight average particle size (D4) of 6.5 $\mu$m are obtained. (S3) 100 parts by mass of the obtained toner particles is mixed with outward additives, i.e., 1.0 part by mass of strontium titanate and 1.3 parts by mass of hydrophobic silica fine powder having 80% methanol wettability and the BET specific surface of 120 $m^2/g$, which is obtained through the hydrophobic process with 15 wt % of hexamethyldisilazane and 15 wt % of dimethyl silicone. As a result, the toner T (I) having the following composition is prepared.

| | |
|---|---|
| bonding resin | 100 parts by mass |
| magnetic iron oxide particles | 90 parts by mass |
| wax | 4 parts by mass |
| charge control agent | 2 parts by mass |

The wettability of the thus obtained magnetic toner T(I) relative to a mixture solution of methanol and water is measured at the transmittance of light having a wavelength of 780 nm. As a result, the methanol concentration at the transmittance of 80% is within the range of 45 to 65 volume %, and the methanol concentration at the transmittance of 10% is within the range of 45 to 65 volume %.

When the difference is reduced between the methanol concentration when the magnetic toner begins wet by the methanol-water solution and the methanol concentration until the toner is completely wet, this means that the material such as magnetic iron oxide is dispersed uniformly across the surface of the toner, and that the environmental stability and the charging uniformity are superior.

A brief explanation will be given for a measurement method using the methanol-dropping permeability curve, which is employed for this invention to measure the wettability of the magnetic toner, i.e., to measure the hydrophobicity. This method is performed by using powder wettability testing machine WET-100P by Resca Co., Ltd., for example, is employed, and by employing the methanol-dropping permeability curve obtained under the following conditions and through the following procedures.

Figure 3:
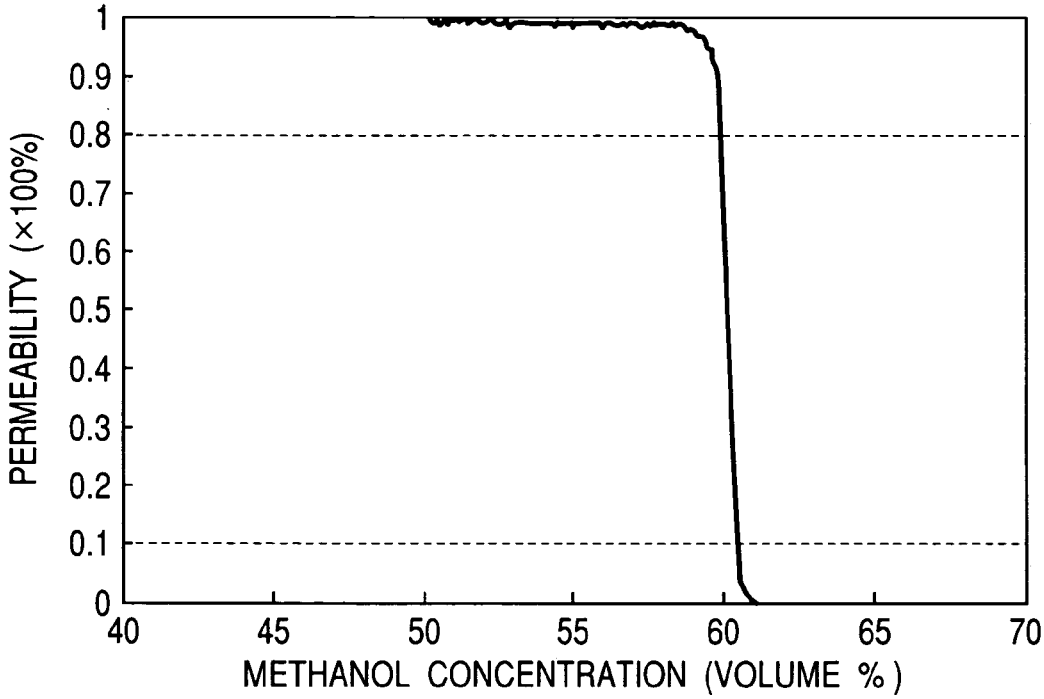
FIG. 3 is a graph showing a methanol-dropping permeability curve according to a first-embodiment of the present invention.

(S1) First, a methanol solution of 70 ml that contains 40 volume % of methanol and 60 volume % of water is poured in a container, and the dispersion process is performed for five minutes by an ultrasonic dispersion device in order to remove bubbles in a test sample. (S2) The magnetic toner that is an analyte is measured accurately by 0.5 g and is added to this resultant solution, and a sample solution is prepared to measure the hydrophobicity of the magnetic toner. (S3) Then, while the sample solution is agitated at the speed of 6.67 $s^{-1}$, methanol is continuously added at the dropping speed of 1.3 ml/min., and the permeability is measured using light having a wavelength of 780 nm. As a result, as is shown in FIG. 3, the methanol-dropping permeability curve graph is obtained wherein the vertical axis represents the methanol concentration and the horizontal axis represents the permeability. For this measurement, methanol is employed as a titrand because the dye, the pigment and the charge control agent are less eluted from the magnetic toner particles, and the surface condition of the magnetic toner can be more accurately observed.

The method (outward adding condition) for preparing magnetic iron oxide and the toner T for the present invention has been described. However, any other method can be employed so long as the wettability of the toner relative to a methanol-water solution can be optimized.

First Experiment

With this arrangement, in the environment at a low temperature and low humidity (15° C. and 10%) and in the environment at a high temperature and high humidity (30° C. and 80%), continuous printing was performed for an image pattern having the coverage rate of 2%. In any environment, the stable toner electrification amount was maintained during printing of about 200,000 sheets since the process cartridge C was initially used until the toner was exhausted, and satisfactory images could be obtained without reduction of the image density and image failures such as fogging and fading.

Figure 5:
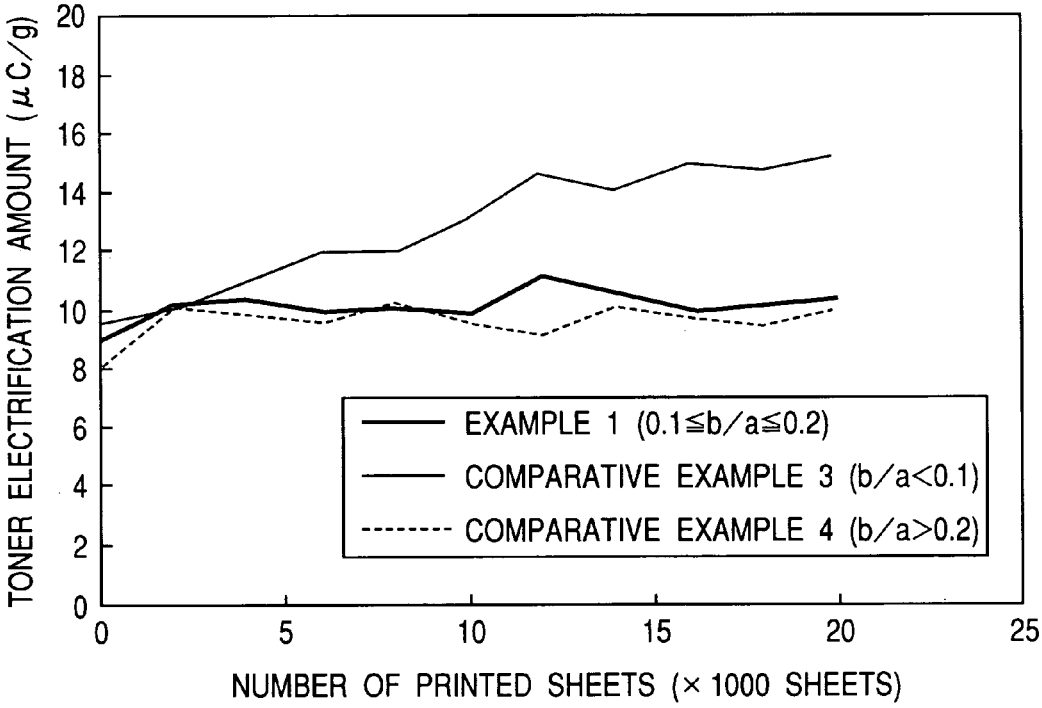
FIG. 5 is a graph showing the relationships between the number of printed sheets and the toner electrification amount in an environment at a low temperature and a low humidity according to the first embodiment, a third comparison example and a fourth comparison example.
Figure 6:
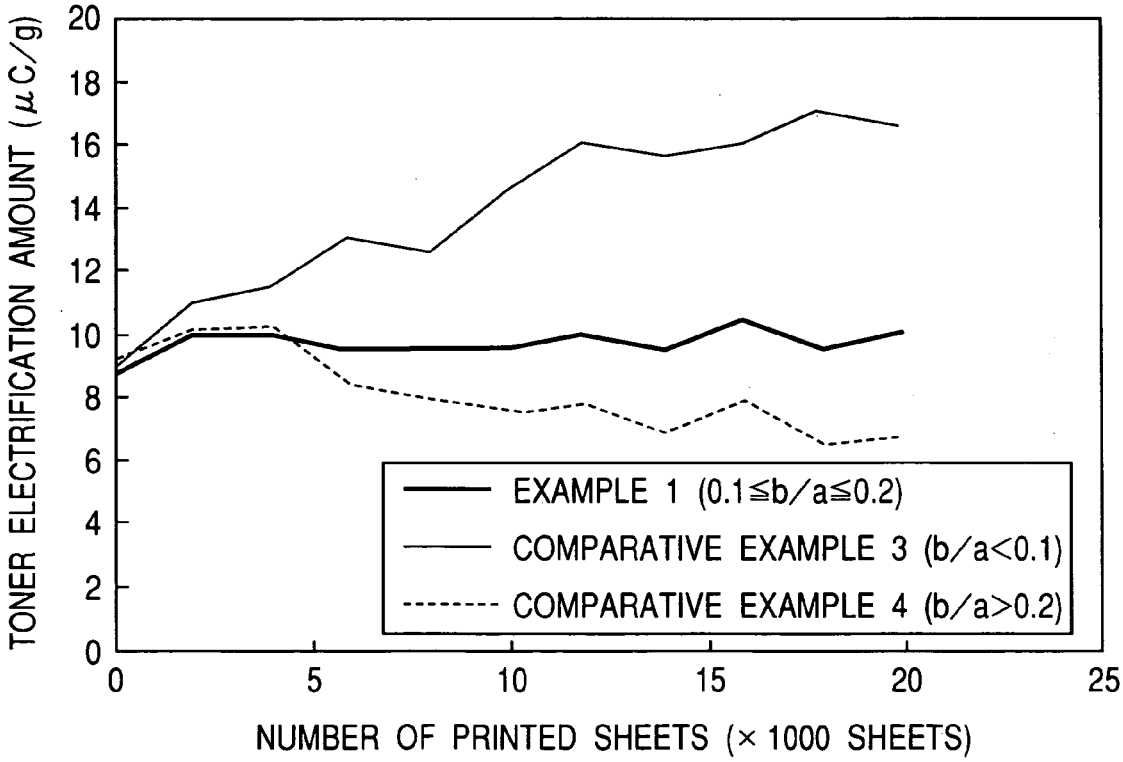
FIG. 6 is a graph showing the relationships between the number of printed sheets and the toner electrification amount in an environment at a high temperature and a high humidity according to the first embodiment, the third comparison example and the fourth comparison example.

In an environment at a low temperature and low humidity and in an environment at a high temperature and high humidity, the amount q ($\mu$C/g) of charged toner carried by the developing roller 2 was measured by a 6514 electrometer by Casley Co., Ltd. using an aspiration method. The measurement results are shown in FIGS. 5 and 6, respectively. It is understood that, in either environment, near the value of −10 was stably obtained as the amount q ($\mu$C/g) of charged toner.

The toner used for the first embodiment is defined as toner (I). Further, toner (II) and toner (III) that have different wettabilities measured by the above described method are employed for first example comparison, and second example comparison. For these example comparisons as well as for the first experiment, continuous printing was performed for an image pattern having the coverage rate of 2% in the environment at a low temperature and low humidity (15° C., 10%) and the environment at a high temperature and high humidity (30° C., 80%).

FIRST EXAMPLE COMPARISON

The structure of a developing apparatus is the same as that for the developing apparatus in FIG. 1, while the toner manufacturing method for the first example comparison partially differs from that for the toner (I).

Specifically, toner particles obtained by classification were passed momentarily through hot air of 300° C. 100 parts by mass of the obtained toner particles were mixed with outward additives, i.e., 1.0 part by mass of strontium titanate and 1.3 parts by mass of hydrophobic silica fine powder having 80% methanol wettability and the BET specific surface of 120 $m^2/g$, which was obtained through the hydrophobic process with 15 wt % of hexamethyldisilazane and 15 wt % of dimethyl silicone. As a result, the toner T (II) was prepared.

Through this processing, one part of magnetic iron oxide present on the surfaces of the toner particles was covered with the resin, and the hydrophobicity (wettability) of the toner was improved.

By using the same method as above, the wettability of the toner T(II) relative to a methanol-water solution was measured at the transmittance of light having 780 nm. The results are shown in Table 1. The methanol concentration at the transmittance of 80% was 68 volume %, and the methanol concentration at the transmittance of 10% was 74 volume %.

As well as in the first experiment, in the environment at a low temperature and low humidity (15-C and 10%) and the environment at a high temperature and high humidity (30-C and 80%), continuous printing using the toner T(II) was performed for an image pattern having the coverage rate of 2%. The high flowability of the toner could be maintained in the environment at a high temperature and high humidity; however, since the electrified state of the toner was strong, the charged toner was uniformly distributed on the developing roller, and fogging occurred locally. Whereas, in the environment at a low temperature and low humidity, as the number of printed sheets was increased, the over-charged state occurred, and in the overall image, the reduction of the image density and the image fogging occurred.

SECOND EXAMPLE COMPARISON

For a second example comparison, while the structure of a developing apparatus is the same as that for the developing apparatus 40 in FIG. 1, the toner manufacturing method partially differs from that for the toner (I).

Specifically, in the pulverization process, the toner aggregate was crushed by a pulverizer using a colliding air current. Then, 100 parts by mass of the obtained toner particles were mixed with outward additives, i.e., 1.0 part by mass of strontium titanate and 1.3 parts by mass of hydrophobic silica fine powder having 80% methanol wettability and the BET specific surface of 120 $m^2/g$, which was obtained through the hydrophobic process with 15 wt % of hexamethyldisilazane and 15 wt % of dimethyl silicone. As a result, the toner T (III) was prepared.

By using the pulverization method, the comminution cost could be reduced; however, since the state where magnetic iron oxide is dispersed across the surface of the toner particles could not be controlled, the hydrophobicity (wettability) of the toner was deteriorated.

The wettability of the toner T(III) relative to a methanol-water solution was measured by the above described method at the transmittance of light having a wavelength of 780 nm. The results are shown in Table 1. The methanol concentration at the transmittance of 80% was 42 volume %, and the methanol concentration at the transmittance of 10% was 43 volume %.

In the same manner as above, in the environment at a low temperature and low humidity (15° C. and 10%) and in the environment at a high temperature and high humidity (30° C. and 80%), continuous printing using the toner (III) was performed for an image pattern having a coverage of 2%. As a result, in the environment at a high temperature and high humidity, the flowability of the toner was extremely poor, and an image failure occurred due to the deterioration of the toner. Further, in the environment at a low temperature and low humidity, fogging occurred because the toner was not appropriately electrified.

According to Table 1 showing the wettabilities of the toner (I), the toner (II) and the toner (III), when the wettability of the toner (I) relative to the methanol-water solution was measured at the transmittance of light having a wavelength of 780 nm, the methanol concentration at the transmittance of 80% was within the range of 45 to 65 volume %. When the wettability of the toner (I) relative to the methanol-water solution was measured at the transmittance of light having a wavelength of 780 nm, the methanol concentration at the transmittance of 10% was within the range of 45 to 65 volume %. The methanol concentrations for the toners (II) and (III) are in the range other than those.

TABLE 1

| | Toner | | |
|---|---|---|---|
| | T (I) | T (II) | T (III) |
| Methanol concentration (volume %) at transmittance of 80% | 60 | 68 | 42 |
| Methanol concentration (volume %) at transmittance of 10% | 60.5 | 74 | 43 |

The following is apparent from the results of the first experiment and the first and second example comparisons.

When the toner is prepared so that the wettability relative to the methanol-water solution is within the above described ranges, the ratio whereat the magnetic iron oxide is exposed on the surfaces of the toner particles is appropriate for the one-component magnetic toner including a bonding resin that contains a polyester resin as the main component. Further, satisfactory electrification stability can be maintained, and the reduction of the image density and an image failure, such as fogging, can be prevented.

In addition to the feature of the invention that the appropriate wettability of the toner is defined, another feature is that, when the agitating member is rotated at a rotation speed b (rps) that is constant relative to a rotation speed a (rps) of the developing roller, $0.1 \leqq b/a \leqq 0.2$ is satisfied. It should be noted that (rps) represents the number of revolutions for one second.

For the developing apparatus 40 for the first embodiment, the amount of the loaded toner T(I) is 1000 (g); the peripheral speed d of the developing roller 2 having the outer diameter of 20 mm is 220 (mm/sec), i.e., the rotation speed a of the developing roller 2 is 3.5 (rps); and the rotation speed b of the agitating member 6 having the rotation radius of 40 mm is 0.525 (rps). Therefore, the relationship of $0.1 \leqq b/a \leqq 0.2$ is established.

Figure 4:
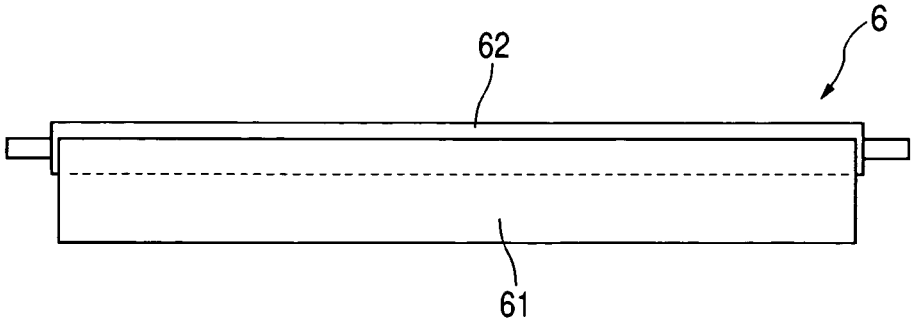
FIG. 4 is a longitudinal front view of an example agitating member according to the present invention.

Further, as is shown in FIG. 4, the agitating member 6 is so designed that a PPS (polyphenyl sulfide) sheet member 61, which is a flexible sheet of 100 $\mu$m thick, is glued to a support member 62 that serves as a rotation shaft.

Since the flexible sheet member 61 such as a PPS is employed as a member to be glued to the rotation shaft of the agitating member 6, in the initial usage period for the process cartridge C, an excessive torque can be prevented from being loaded to the agitating member 6 even after the vibration (tapping) has occurred during the shipping of the process cartridge C and the density of the toner in the toner container 4 has been increased.

In order to satisfactorily circulate the toner in the toner container 4, it is preferable that the rotation radius of the agitating member 6 be greater at least than the rotation radius of the developing roller 2. It is also preferable that the rotation radius of the agitating member 6 be smaller than seven times of the rotation radius of the developing roller 2.

In the first embodiment, the rotation speed a of the developing roller 2 is constant during the image forming process, regardless of the image coverage rate and the image resolution. Furthermore, the agitating member 6 is synchronized with the developing roller 2 through a gear strain (not shown), and the rotation speed ratio b/a is always constant.

For third and fourth example comparisons, continuous printing as well as for the first experiment was performed by changing the rotation speed ratio b/a, and the differences from the first embodiment were examined.

THIRD EXAMPLE COMPARISON

The same processes as the first embodiment were performed, except in that the rotation speed b(rps) of the agitating member 6 was set to 0.315 ($0.1 > b/a$).

When the continuous printing was performed under the same condition as for the first experiment, the toner circulation in the toner container 4 became small. Thus, as the number of printed sheets was increased, the toner retained on the reverse side of the developing roller 2 was overly electrified, and image fogging and the reduction of the image density occurred.

Especially in the environment at a high temperature and high humidity, since the flowability of the toner was deteriorated, the toner retained on the reverse side of the developing roller 2 tended to be overly electrified. Further, the toner was deteriorated due to the occurrence of the packing state, so that the reduction of the image density, the image fogging, the image fading occurred due to insufficient supply of the toner to the developing roller 2.

FOURTH EXAMPLE COMPARISON

The same processes as for the first embodiment were performed, except in that the rotation speed b(rps) of the agitating member 6 was set to 0.735 ($0.2 < b/a$).

When the continuous printing was performed under the same conditions as for the first experiment, the toner circulation in the toner container 4 became large. However, since the flowability of the toner was high especially in the environment at a low temperature and low humidity, the toner circulation was increased more than necessary. Thus, when the process cartridge C was initially used, the rising of the electrification of the toner was not satisfactory, so that the reduction of the image density and the fogging occurred at the early time.

Further, in the environment at a high temperature and high humidity, while packing of toner and the image fading did not occur, the toner was quickly deteriorated due to the mechanical damage caused by the agitating member, and as the number of printed sheets was increased, the reduction of the image density and the image fogging occurred due to a charging failure.

For the first experiment and the third and fourth example comparisons, in the environment at a low temperature and low humidity and in the environment at a high temperature and high humidity, the amount q ($\mu$C/g) of charged toner carried on the developing roller 2 was measured by a 6514 electrometer by Casley Co., Ltd. using the aspiration method. The results are shown in FIGS. 5 and 6.

For the first embodiment, it is apparent that, in either environment, near the value of −10 could be stably obtained as the amount q ($\mu$C/g) of the charged toner. However, for the third and fourth example comparisons for which the relationship of $0.1 \leqq b/a \leqq 0.2$ is not established, the amount of the charged toner was not stabilized and an image failure occurred.

Under the condition where the amount of each loaded charged toners T(I), T(II) and T(III) was 1000 (g), the peripheral speed d of the developing roller 2 was 220 (mm/sec), and the rotation speed a of the developing roller 2 was 3.5 (rps), the continuous printing was performed at a predetermined rotation speed b of the agitation member 6 within the range of 0.175 to 1.05 ($0.05 \leqq b/a \leqq 0.3$). The image density, the image fogging, and the image fading were evaluated. The results are shown in Tables below.

TABLE 2

| | Toner T (I) | | | | | | | |
|---|---|---|---|---|---|---|---|---|
| | B/a | | | | | | | |
| | 0.05 | 0.09 | 0.1 | 0.15 | 0.2 | 0.21 | 0.25 | 0.3 |
| Density reduction | X | Δ | ○ | ○ | ○ | Δ | Δ | X |
| Image fogging | X | Δ | ○ | ○ | ○ | Δ | Δ | X |
| Image fading | X | Δ | ○ | ○ | ○ | ○ | ○ | X |

○: not occurred
Δ: slightly occurred
X: occurred in an entire image

TABLE 3

| | Toner T (II) | | | | | | | |
|---|---|---|---|---|---|---|---|---|
| | b/a | | | | | | | |
| | 0.05 | 0.09 | 0.1 | 0.15 | 0.2 | 0.21 | 0.25 | 0.3 |
| Density reduction | X | X | Δ | ○ | ○ | Δ | Δ | X |
| Image fogging | X | X | Δ | Δ | Δ | Δ | X | X |
| Image fading | Δ | Δ | ○ | ○ | ○ | ○ | ○ | Δ |

○: not occurred
Δ: slightly occurred
X: occurred in an entire image

TABLE 4

| | Toner T (III) | | | | | | | |
|---|---|---|---|---|---|---|---|---|
| | B/a | | | | | | | |
| | 0.05 | 0.09 | 0.1 | 0.15 | 0.2 | 0.21 | 0.25 | 0.3 |
| Density reduction | X | X | X | Δ | Δ | X | X | X |
| Image fogging | X | X | Δ | ○ | ○ | Δ | X | X |
| Image fading | X | X | Δ | ○ | ○ | Δ | X | X |

○: not occurred
Δ: slightly occurred
X: occurred in an entire image

As apparent from these results, when the toner T(I) was employed and when the relationship of $0.1 \leqq b/a \leqq 0.2$ was established between the rotation speed b (rps) of the agitating member 6 and the rotation speed a (rps) of the developing roller 2, no image failure occurred, and satisfactory images could be printed until the toner was exhausted.

As is described above, when the magnetic toner is employed for which the appropriate hydrophobicity is obtained by optimizing the state where the material is dispersed across the surface of the toner particles, and when the rotation speed b (rps) of the agitating member and the rotation speed a (rps) of the developing roller are set so as to establish the relationship of $0.1 \leqq b/a \leqq 0.2$, an image failure does not occur and satisfactory images can be obtained even when the fast developing system storing a large amount of toner is used for an extended period of time.

In this embodiment, when the wettability of the one-component magnetic toner relative to the methanol-water solution is measured at the transmittance of light having a wavelength of 780 nm, the methanol concentration at the transmittance of 10% is within the range of 45 to 65 volume %, so long as the methanol concentration at the transmittance of 80% is within the range of 45 to 65 volume %. Thus, this evaluation is regarded as within the scope of the present invention.

The agitation member is not limited to the one for this embodiment, and so long as the Mylar or a PET sheet is glued to the rotation sheet, the same effects can be obtained.

Second Embodiment

An image forming apparatus and toner used for a second embodiment are the same as those for the first embodiment.

Figure 7:
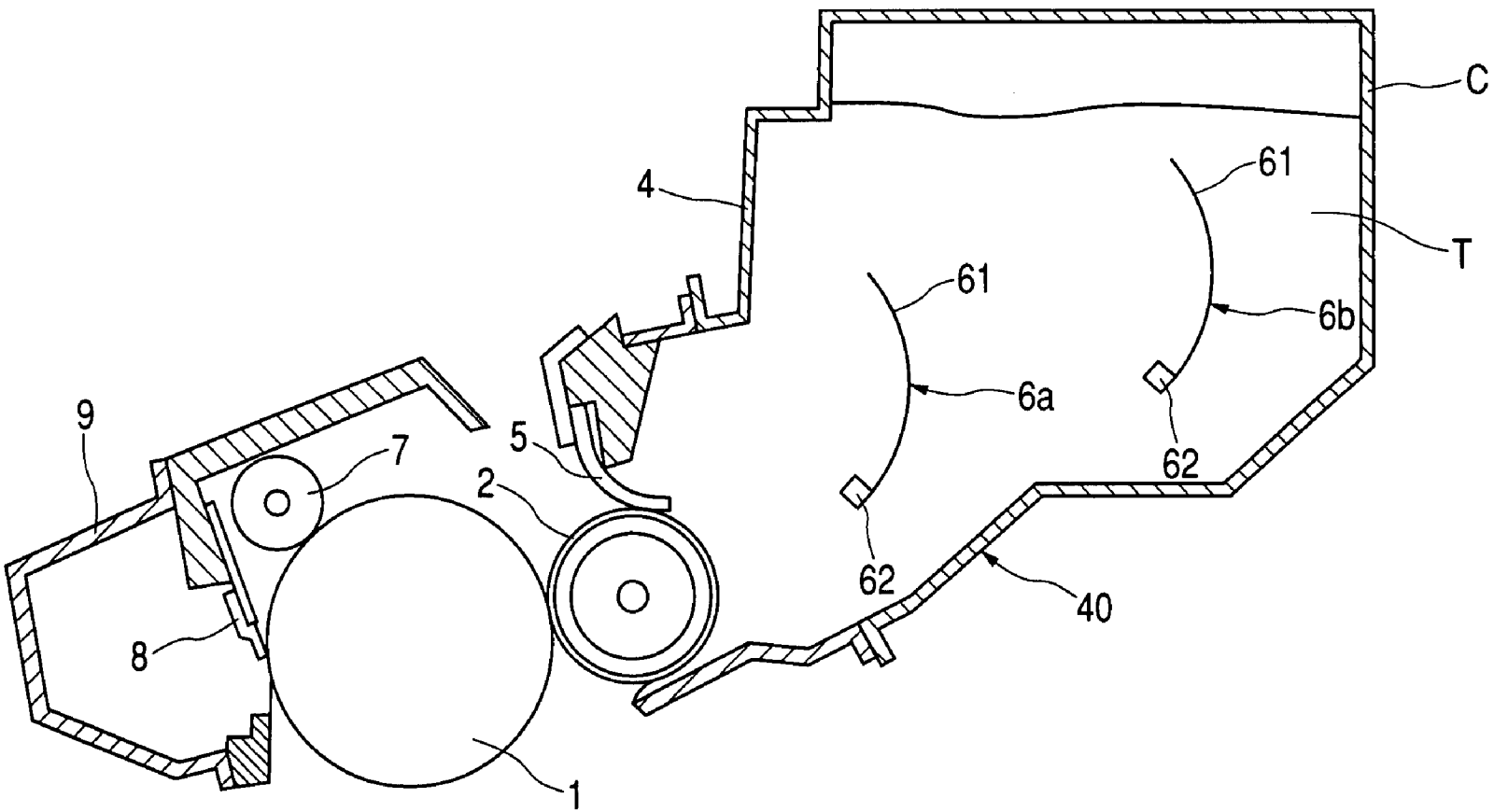
FIG. 7 is a cross-sectional view according to another example processing cartridge according to a second embodiment of the present invention.

As is shown in FIG. 7, a developing apparatus 40 according to the second embodiment has a feature that a larger amount of toner is stored and a plurality of agitating members 6*a* and 6*b* are provided for a toner container 4.

With this arrangement, the own weight of the toner can be dispersed, and the circulation of the toner in the toner container 4 can be increased. Therefore, the capacity of a process cartridge C can be more increased.

This embodiment is the same as the first embodiment, except in that the amount of loaded toner is 1500 (g), the rotation speed c of the agitating member 6*a* closer to a developing roller 2 is 0.525 (rps), and the rotation speed e of the agitating member 6*b* farther from the developing roller 2 is 0.25 (rps).

The rotation radii of the agitating members 6*a* and 6*b* are 40 mm, and as is shown in FIG. 4, these agitating members 6*a* and 6*b* are so designed that a PPS (polyphenyl sulfide) sheet 61 of 100 μm thick is glued to a support member 62.

Further, from the viewpoint of the reduction of the torque, it is preferable that the rotation phases of the agitating members 6*a* and 6*b* be shifted from each other.

With this configuration, in the environment at a low temperature and low humidity (15° C. and 10%) and in the environment at a high temperature and high humidity (30° C. and 80%), the continuous printing was performed for an image pattern having a coverage rate of 2% in the same manner as in the first experiment conducted for the first embodiment. In either environment, the stable toner electrification amount was maintained during the printing of about 300,000 sheets since the process cartridge C was initially used until the toner was exhausted. As a result, satisfactory images were obtained while the reduction of the image density and image failures, such as the image fogging and the image fading, did not occur.

According to the configuration of this embodiment, the relationship of $0.1 \leqq c/a \leqq 0.2$ is established for the agitating member 6*a* close to the developing roller 2, while the relationship of $0.1 \leqq e/a \leqq 0.2$ is not established for the agitating member 6*b* farther from the developing roller 2. This means that the toner circulation in the toner container 4 in the vicinity of the developing roller 2 is under the domination of the rotation speed c of the agitating member 6*a* close to the developing roller 2, and does not depend on the rotation speed e of the agitating member 6*b* farther from the developing roller 2.

However, it is important that the rotation speed e of the agitating member 6*b* be set within the range that the toner can be uniformly carried to the developing roller 2 and does not cause a mechanical damage to the toner. Therefore, it is preferable that the rotation speed e of the agitating member 6*b* be set within the range that the relationship of $0.06 \leqq e/a \leqq 0.23$ is established, and more preferably within the range of $0.1 \leqq e/a \leqq 0.2$.

As is described above, for the developing apparatus where a plurality of agitating members 6*a* and 6*b* are provided in the toner container 4, the rotation speed c of at least the agitating member 6*a* located near the developing roller 2 is set within the range that the relationship of $0.1 \leqq c/a \leqq 0.2$ is established, so that, for an extended period of time, satisfactory images can be obtained without an image failure.

The process cartridge C for this embodiment comprises electrifying means and clearing device, in addition to the developing apparatus and the latent image bearing body such as a photosensitive member. However, the present invention can also be applied for a process cartridge that includes either electrifying means or cleaning means, or neither of them.

Furthermore, the image forming apparatus is not limited to the one shown in FIG. 2, and the present invention can also be applied for a configuration where the process means, such as the developing apparatus and the image bearing body, are not integrally formed as a process cartridge, but are separately provided. Further, the developing apparatus need not be always detachable to the main body of the image forming apparatus.

In addition, for a color image forming apparatus that employs a plurality of process cartridges or developing apparatuses, and that superposes toner images of multiple colors to form a color image, the present invention can also be applied for these process cartridges or these developing apparatuses.

The scope of the present invention is not limited to the sizes, the materials, the shapes and the positions of the components of the developing apparatus, the process cartridge and the image forming apparatus in the embodiments, unless a specific description is given.

As is described above, for the developing apparatus of the present invention, when the wettability of the magnetic toner relative to the methanol-water solution is measured at the transmittance of light having a wavelength of 780 nm, the methanol concentration at the transmittance of 80% is within the range of 45 to 65 volume %, and $0.1 \leqq b/a \leqq 0.2$ is established between the rotation speed a (rps) of the developer carrying body and the rotation speed b (rps) of the agitating member. Therefore, when the magnetic toner is employed for which the high hydrophobicity is provided by optimizing the state where the material is dispersed across the surface of the toner, and when the rotation speed of the agitating member is optimized, satisfactory images can be obtained without an image failure even when a fast developing system storing a large amount of toner is used for an extended period of time.

What is claimed is:

1. A developing apparatus comprising:

a rotatable, developer carrying body for carrying a one-component developer; and a rotatable, agitating member for agitating the one-component developer, wherein said one-component developer is magnetic toner at least containing a bonding resin and magnetic iron oxide, wherein, when wettability of the magnetic toner relative to a mixture solution of methanol and water is measured at transmittance of light having a wavelength of 780 nm, a methanol concentration at the transmittance of 80% is within the range of 45 to 65 volume %, and wherein $0.1 \leqq b/a \leqq 0.2$ is established where a (rps) denotes a rotation speed of said developer carrying body, and b (rps) denotes a rotation speed of said agitating member.

2. A developing apparatus according to claim 1, wherein the rotation speed b (rps) of said agitating member is constant relative to the rotation speed a (rps) of said developer carrying body.

3. A developing apparatus according to claim 1, wherein the bonding resin contains a polyester resin.

4. A developing apparatus according to claim 1, wherein, when the wettability of the magnetic toner relative to the mixture solution of methanol and water is measured at the transmittance of light having a wavelength of 780 nm, the methanol concentration at the transmittance of 10% is within the range of 45 to 65 volume %.

5. A developing apparatus according to claim 1, wherein said developing apparatus includes a second agitating member, said agitating member is disposed nearer to said developer carrying body than said second agitating member, and a rotation radius of said agitating member is greater than a rotation radius of said developer carrying body.

6. A developing apparatus according to claim 1, wherein said agitating member includes a rotation shaft and a flexible sheet member.

7. A developing apparatus according to claim 1, further comprising:

a developer container in which the developer is contained, wherein said agitating member is provided in said developer container.

8. A developing apparatus according to claim 1, which is detachable to a main body of an image forming apparatus.

9. A developing apparatus according to claim 1, wherein a rotation radius of said agitating member is greater than a rotation radius of said developer carrying body.

10. A developing apparatus according to claim 1, wherein a rotation radius of said agitating member is smaller than seven times of the rotation radius of said developer carrying body.

11. A developing apparatus according to claim 1, which is mounted to a process cartridge detachable to a main body of an image forming apparatus, together with an image bearing body acted on by said developing apparatus.

12. A developing apparatus according to claim 1, which is mounted to an image forming apparatus, together with an image bearing body acted on by said developing apparatus.

* * * * *

UNITED STATES PATENT AND TRADEMARK OFFICE

CERTIFICATE OF CORRECTION

PATENT NO. : 7,003,249 B2
APPLICATION NO. : 10/701417
DATED : February 21, 2006
INVENTOR(S) : Hideaki Hasegawa et al.

It is certified that error appears in the above-identified patent and that said Letters Patent is hereby corrected as shown below:

COLUMN 3:

Line 29, “i.e,” should read --i.e.,--; and
Line 59, “fiction” should read --friction--.

COLUMN 4:

Line 67, “can not” should read --cannot--.

COLUMN 5:

Line 50, “first-embodiment” should read --first embodiment--.

COLUMN 6:

Line 65, “sued” should read --used--.

COLUMN 9:

Line 16, “above described” should read --above-described.--.

COLUMN 10:

Line 24, “above described” should read --above-described--.

COLUMN 11:

Line 24, “above described” should read --above-described--.

UNITED STATES PATENT AND TRADEMARK OFFICE

CERTIFICATE OF CORRECTION

PATENT NO. : 7,003,249 B2
APPLICATION NO. : 10/701417
DATED : February 21, 2006
INVENTOR(S) : Hideaki Hasegawa et al.

It is certified that error appears in the above-identified patent and that said Letters Patent is hereby corrected as shown below:

COLUMN 16:

Line 34, "the" should read --a--.

Signed and Sealed this

Fifteenth Day of August, 2006

JON W. DUDAS
*Director of the United States Patent and Trademark Office*